US007240793B2

(12) United States Patent
McBain

(10) Patent No.: US 7,240,793 B2
(45) Date of Patent: Jul. 10, 2007

(54) METHOD AND APPARATUS AIDING IN THE MANAGEMENT OF MULTIPLE MEDICATIONS

(75) Inventor: Dalene June McBain, Mosier, OR (US)

(73) Assignee: Dalene J. McBain, Mosier, OR (US)

( * ) Notice: Subject to any disclaimer, the term of this patent is extended or adjusted under 35 U.S.C. 154(b) by 213 days.

(21) Appl. No.: 10/982,226

(22) Filed: Nov. 3, 2004

(65) Prior Publication Data

US 2005/0092647 A1 May 5, 2005

Related U.S. Application Data

(60) Provisional application No. 60/517,754, filed on Nov. 5, 2003.

(51) Int. Cl.
*B65D 83/04* (2006.01)
*B42D 15/00* (2006.01)

(52) U.S. Cl. ..... 206/534; 206/232; 283/67; 283/115; 283/900

(58) Field of Classification Search ..... 206/531–534, 206/538–539, 232; 283/48.1, 67, 81, 115, 283/900; 705/3
See application file for complete search history.

(56) References Cited

U.S. PATENT DOCUMENTS

| | | | | |
|---|---|---|---|---|
| 3,515,265 | A * | 6/1970 | Bartnik | 206/534 |
| 3,675,620 | A * | 7/1972 | Baustin | 206/534 |
| 4,148,273 | A * | 4/1979 | Hollingsworth et al. | 283/900 |
| 4,752,087 | A | 6/1988 | Weisbach | |
| 4,815,767 | A | 3/1989 | Lambert | |
| 4,905,388 | A | 3/1990 | Sinkow | |
| 5,261,702 | A | 11/1993 | Mayfield | |
| 5,431,450 | A | 7/1995 | Coleman | |
| 5,669,503 | A | 9/1997 | Robin | |
| 5,758,096 | A * | 5/1998 | Barsky et al. | 705/3 |
| 5,979,698 | A | 11/1999 | Deal | |
| 6,293,403 | B1 | 9/2001 | Holmberg | |
| 6,681,935 | B1 | 1/2004 | Lewis | |
| 2002/0041091 | A1 * | 4/2002 | Eippert | 283/900 |

* cited by examiner

*Primary Examiner*—Bryon P. Gehman

(57) ABSTRACT

A multiple medication management system and method enables patients and caregivers to accurately track medications on a compact chart. The system and method use a plurality of containers for storage of current medications, medications needing refills, and medications discontinued by a physician. Thus, patients and caregivers are able to efficiently and accurately track medications, including which medications need refilling. Furthermore, discontinued medications can be safely retained in case they are later prescribed again by a patient s physician.

4 Claims, 10 Drawing Sheets

Figure 1

200

| Med# | A MEDICATION NAME What does it looks like? | B DOSE | C BEFORE MEALS | D WITH FOOD | E MORN | F NOON | G EVE | H BED | I TREATMENT OF WHAT? | J PRESCRIPTION NUMBER Special Inst. | K REFILL DATE | L ✓ CK |
|---|---|---|---|---|---|---|---|---|---|---|---|---|
| 1 | | | | | | | | | | | | |
| 2 | | | | | | | | | | | | |
| 3 | | | | | | | | | | | | |
| 4 | | | | | | | | | | | | |
| 5 | | | | | | | | | | | | |
| 6 | | | | | | | | | | | | |
| 7 | | | | | | | | | | | | |
| 8 | | | | | | | | | | | | |
| 9 | | | | | | | | | | | | |
| 10 | | | | | | | | | | | | |

11 12 13 14 15 16 17 18 19 20 21 22 23

METHOD AND APPARATUS AIDING IN THE MANAGEMENT OF MULTIPLE MEDICATIONS

REFERENCE TO RELATED APPLICATIONS

This application claims the benefit of U.S. Provisional Application No. 60/517,754 filed Nov. 5, 2003.

COPYRIGHT

A portion of the disclosure of this patent document contains material, which is subject to copyright protection. The owner reserves all copyright rights to the Medication Chart and Step-By-Step Instructions.

BACKGOUND OF THE INVENTION

1. Field of the Invention

This invention relates to a method and apparatus for the management of multiple medications.

2. Prior Art Statement

The introduction of new medications today, along with other advances in modern medicine, undoubtedly are allowing many people the opportunity to live longer and have a better quality of life. However, along with these advances come unintended consequences causing a serious new public health problem. Medication related problems can cause needless disability, falls, confusion, depression, and loss of independence.

Medication related problems are now reportedly the third leading cause of death in the over-65 age group.

While medication related problems are unpredictable, a host of medication-related problems can be anticipated and prevented. Medication related death, illness, and disability frequently result from a number of controllable factors including: under-use of medications, over-use of medications, use of inappropriate medications, adverse drug reactions (including drug interactions), and a lack of adherence to drug therapy (patient non-compliance.)

More often the mismanagement of medications is found in people who may have one or more chronic illnesses (such as diabetes and congestive heart failure,) and are on numerous medications (sometimes as many as 20-30,) where medications may change every few days. During this time the doctor is trying to find a balance to help the patient, with the use of prescription drugs, maintain a good quality of life. This problem grows even more acute when multiple doctors are prescribing medications. Unknowingly, these doctors can be unaware of what a patient is ingesting. Conflicts can happen between prescription drugs, as well as over-the-counter medications, supplements, vitamins, and herbal remedies. This problem can lead to over-medication.

Often during the course of finding this balance for the body, a doctor may try new medications, replacing a drug with a new drug, only to find the previous medication worked best. The patient is told to revert to the previous medication prescribed. It is not uncommon for a multi-medicated person to lack the clearness of mind to understand when to stop taking one medication and to begin taking the new medication only, thus the patient takes both medications. This situation also leads to over-medication. The side effects are severe from over-medicating or under-medicating, leading to more emergency room visits, ambulance calls and longer hospital stays.

Medications are extremely expensive. Costly medications can be thrown away when a doctor replaces a medication with a different drug, which may work better. Or, the bottle is misplaced somewhere in the home. Either way, the patient must purchase this medication again. Many people are purchasing medications before buying food, which the patient s bodies need in order to have a chance of becoming healthy. In addition, hundreds of dollars in medications are going into wastebaskets or are misplaced in the home.

Another issue in managing multiple medications is the problem of running out of pills. This problem can cause delay of ingestion of medications at the proper time. Often, when a person is on several medications, the patient doesn t realize until having taken the last pill from the bottle or doesn t notice until the time when the patient goes to get a pill that the bottle is empty. This chronically ill person may not feel well enough to drive to the pharmacy to get prescriptions and must make arrangements with a family member, friend, or caregiver to pick up prescriptions as typically a person this medicated does not drive a vehicle. When a person is taking multiple medications, medication issues arise frequently and can likely force a daily trip to the pharmacy. These trips create an even longer delay in a medicine regime, becoming dangerous, as these powerful medications are often keeping a person alive. Again, this delay can result in needless trips to the emergency room, calling an ambulance to the home and longer hospital stays. In the United States, the cost of treating problems related to mishandling of medications, in the elderly alone, is in the billions of dollars.

Another problem people have, who are on multiple medications, is pill bottles with powerful medications in them are often found in many places throughout the house. When there are young children living in the home or visiting on occasion, the danger of these children getting into pill bottles and ingesting drugs can be extremely high, leading to hospitalization and sometimes even death. For example, elderly people often do not have the pharmacist put the childproof caps on their medications because they cannot then get the caps off themselves. Even with childproof caps, these plastic pill bottles can still be broken and medications ingested by young children.

Further problems arise when there are two people in the same household on medications. The prescription bottles can get mixed up and one person takes the other person s pills. These people may have poor eyesight and pick up the wrong bottle, ingesting say a blood pressure medication, having already taken this medication in the morning, and now taking a second pill by mistake. This double dosage can be very dangerous, even life-threatening. If nothing else, excess medication can make a person extremely ill and afraid, thus causing the patient to call an ambulance, head for the emergency room and possibly check into the hospital.

Another problem is that most patients do not understand medications, why medications are being taken and what medications do when they get into the body. These are questions a patient may have. Often, a patient may not ask many questions of physicians and therefore know little about the medications being prescribed and the purpose of these medications. Knowing what, when and why medications are needed eases fear, anxiety, and gives a person a sense of more control over life. This knowledge leaves the person feeling more independent, when often, due to ailments, so much has already been taken from the person.

More often than not today a chronically ill person is sent home from the hospital with a family member, friend or caregiver. Services are offered to help chronically ill people and families through Home Health Agencies, Visiting Health Nurses, Hospice and other agencies. These agency personnel come to the home, take vitals, check on medications, and generally assist in the physical and mental care of a chronically ill person. Most of the time, however, the family member, friend or caregiver has the responsibility of organizing and dispensing of medications on a daily basis. The caregiver managing a multi-medication situation, especially if that caregiver is a family member or friend, is often very stressed dealing with the emotional and physical daily regime of caring for a chronically ill person. The additional responsibility of administering 20 or 30 medications on top of that stress can additionally burden the caregiver. The fears of giving the wrong medication at the wrong time, giving an improper medication dosage, or forgetting to give medications are some of the issues needing to be addressed. These issues are especially important when there is more than one caregiver. It is often unclear what is going on when it comes to all the medications a person is ingesting. All caregivers need to be on the same page. When Home Health, Visiting Nurses or Hospice personnel visit, they need to know the precise situation regarding the patient s medications.

Another problem occurs when an ambulance is called to the home of a chronically ill person and little is known about the medications the patient is taking. Such lack of knowledge can be a life or death situation for the patient and very confusing to the paramedics. Whereas, if the paramedics had a list of the medications this person was taking, the paramedics would have a better idea as to what has happened and be more able to treat the patient on the spot. It makes it difficult in an emergency situation to treat a patient who may be taking several medications. The patient may have missed or doubled up on some medications and may be having a reaction to one or more of the medications, thus causing this emergency. Often, no person in the home knows or remembers the medication regime. Pill bottles are gathered from throughout the home and the bottles given to the paramedics, but these paramedics do not necessarily know what medication has been taken and, what medication has not, been taken by the patient.

Conventional methods and systems for medication management do not currently take into account simplicity and yet address all of the above-mentioned major issues. Some methods containerize the pills in a pill organizer, yet do not address the issue of when medications are changed or discontinued. Patients using such a system are likely taking the discontinued medication as well as the new drug prescribed in its place because the pills have already been placed in a weekly pill organizer for the week. This problem can also occur if the dosage changes on a medication. The person may put the new medication into the pill organizer without taking out the discontinued medication. Most often with a conventional system or method, pill bottles are left somewhere in the home such as lining a counter, in a cupboard, a drawer, on a nightstand, the coffee table where television is watched, or in multiple locations. Often the medications are easily accessible to small children.

Some prior art methods place medications in a prefabricated blister pack, with the name of the patient, medication, dosage, time of day, day of the week, and Julian date, provided on each blister pack. These blister packs can be filled and sealed at the pharmacy as disclosed in U.S. Pat. No. 6,681,935 issued Jan. 27, 2004. The sealing foil or sheet, when removed, indicates to the patient the medication has been taken. An apparent disadvantage to a method such as this method is it is cumbersome to use, and the blister packs are difficult to change, because a pharmacist must fill the blister packs. Another apparent disadvantage to this system is how the medication information is printed on the packaging, as the writing on the blister packs might be too small to read.

One method and system for documenting and controlling the taking of medication disclosed in U.S. Pat. No. 4,815,767 issued Mar. 29, 1989, uses a chart placed on a table or hung on a wall and comes with 8 different shaped stickers. These stickers are placed on the chart, within the day and time the medication should be taken, and the same sticker is placed on the bottle, making it easy to locate the pill bottle when that medication is to be taken. Each medication is assigned a different shaped sticker. The person looks at the chart, noting which sticker is in the time slot for the medication the person needs to ingest and finds the bottle with the same shape sticker on it. This system is designed for the elderly and mentally/physically impaired. Once a medication is taken a mark is made on the chart. An apparent disadvantage to this system such as this is it is limited in space to the number of stickers, which could be adhered to the chart in the areas provided. With multiple medications, there can be several pills taken at the same time of the day.

Yet another similar system, a daily medication management system disclosed in U.S. Pat. No. 5,261,702, issued Nov. 16, 1993, uses a wall chart with an erasable transparent plastic surface. Different shaped stickers are placed on the pill bottles and on the chart board in their time slot when the medication needs to be taken. This system uses different shaped pushpins. These pins are the same shape as the coinciding stickers on the pill bottles. The board can be marked on, making notes for refills or doctor appointments. An apparent disadvantage to this system is the limitation in space on the wall chart to list many medications. Another disadvantage is these pushpins could be misplaced, or fall off the board and a medication missed. Yet another apparent disadvantage to a method such as this is that if medications are changed often, the writing on the chart would have to be done daily and could become confusing depending on the number of medications listed. For these reasons, this method is tedious and confusing.

U.S. Pat. No. 5,669,503, issued Sep. 23, 1997, discloses, a medication dose control apparatus where medications are placed in the chambers of the apparatus and are to be taken at specific times of the day. An apparent disadvantage to this method is there is no system along with this device for medication ingestion control.

U.S. Pat. No. 5,979,698, issued Nov. 9, 1999, discloses, a method and means for recording periodic medicinal dosages. This method has a recording device, which is placed on the medication container corresponding to days and dosages. A disadvantage to this method is that it would be cumbersome to use with a multiple medication regime. Each prescription bottle would have to be handled several times per day depending on the frequency medications are to be taken. When there are multiple medications this process could take a great deal of time. Another disadvantage to this method is there is no system along with this device for medication ingestion control.

Another system, a vitamin organizing, storing and dispensing system is disclosed in U.S. Pat. No. 6,293,403, issued Sep. 25, 2001, wherein medications are packaged in small zippered clear plastic packets for each time of the day they are taken. An apparent disadvantage to this system is difficulty of use. This system is excessively time-consuming as a person has many packets to put together and seal. Furthermore, the system is prone to mistakes such as placing the wrong pills or forgetting a pill in a given packet. These packets are then placed in a pill-organizing tray for storage.

An apparent disadvantage to this method is there is no system along with this device for medication ingestion control.

Another system disclosed in U.S. Pat. No. 4,905,388, issued Mar. 6, 1990, includes an organizer and reminder device for pills, medicines and the like. This system includes a freestanding monthly calendar with slots for each day where a small container fits into a slot for each day of the month. An apparent disadvantage to this system is it would not work for medications taken at different times of the day, as the pills are all put into one container for the whole day. Another apparent disadvantage to this method is there is no system along with this device for medication ingestion control.

U.S. Pat. No. 4,752,087, issued Jun. 21, 1998, discloses a medication record keeping indicia. Labels are affixed onto actual medication containers. This system only labels medicine bottles. An apparent disadvantage to this method is there is no system along with this device for medication ingestion control.

Another system is a Medication Board disclosed in U.S. Pat. No. 5,431,450, issued Jul. 11, 1995. The system is a large board, on which medications are marked. At the bottom of the board is an area designated to place ten medicine bottles. Notes are made in the side column for doctor s visit, refill reminders, and other medical information. A checkmark is placed when a medication has been taken. Colored labels are placed on the board to represent user s dosage of pills. An apparent disadvantage to this method is it only handles 10 medication bottles. Some medication bottles can be 2½ inches in diameter. There is not room in the slots provided for this size bottle. Another disadvantage to this method is the chart board is difficult to transport to the doctor s office or hospital. An additional, apparent disadvantage to this method is there is no system along with this device for medication ingestion control.

It is apparent that there is a need for a simple, easy to use system which enables patients and caregivers to track easily what medications the patient is taking, control reliably the ingestion of medications, manage efficiently the refill of medications, and manage safely and efficiently medications which have been discontinued but may be prescribed again at a later date.

SUMMARY OF THE INVENTION

Although there are medication management systems on the market containing preprinted charts comprising of the name of the medication, dosage, day and time medications are to be taken, there are no complete, yet simple systems, addressing the hard issues of medication management. The object of this invention is to have a complete, organized, simple, easy to read and use, method and apparatus for managing a multitude of medications. An object of the invention is to control which medications are ingested. A further object of the invention is to manage medication refills efficiently and safely. A further object of the invention is to allow patients, caregivers, and health care professionals to record and review which medications a patient is taking. A further object of the invention is to store medications safely. A further object of the invention is to store current medication in a convenient fashion. A further object to this invention is to allow the patient or caregiver to monitor medications, which are discontinued and to store these discontinued medications for possible future use.

In the preferred embodiment, the medication chart measures 11×17 and resides in an 8½×11 portfolio. The portfolio houses the person s medication chart, which can be taken to each doctor s appointment and to the emergency room, and is available to paramedics should the need arise to call an ambulance to the home. The chart can be shown to Home Health, Visiting Health Nurses, Hospice and other agency personnel. All personnel will know exactly which medications a person is ingesting, when prescribed medications are being taken, which over-the-counter supplements, vitamins, herbal remedies are being ingested, and the dosages. The medication chart becomes a medication history for the patient.

This system includes a plurality of labels for the pill bottles and their respective caps, and the chart. In the preferred embodiment, the labels are pre-numbered stickers. Removable stickers cannot be used on the pill bottles, as there is a film on a prescription bottle, which does not allow the removable stickers to stay adhered. Preferably these stickers should be permanent stickers so that they do not accidentally come off the prescription bottle.

The system comes with a plurality of labels for discontinued medications and a plurality of labels for refills. In the preferred embodiment, these refill labels and discontinued labels are removable colored stickers. These colored stickers are placed on the medication chart. Preferably these colored stickers are removable from the chart as they are frequently placed on and are removed from the chart.

In one embodiment, the system includes colored zippered bags for storing current medications, discontinued medications and refills. It will be apparent to one skilled in the art that a variety of containers and container indicators could be substituted for the colored bags. The bags are color-coded coinciding to the colored stickers and are large enough to hold multiple pill bottles. These zippered bags are preferably stored in a container, along with all other supplies for medication management and stored away. Medications are out of sight and can be placed out of reach of small children.

The system comes with a weekly pill organizer large enough to accommodate many medications taken several times a day. Preferably the pill organizer includes easy-to-read lettering, which is also in Braille. Preferably the individual day compartments are removable. Each day s medications can be removed from the weekly pill organizer and taken along if a person needs to leave the home for the day.

In the preferred embodiment the kit includes a corrugated box with a handle for easy carrying. This box, with all supplies, can be stored away out of the reach of small children.

In the preferred embodiment the kit includes a pill counting tray, which is similar to the tray a pharmacist uses to fill prescriptions. Medications are poured onto the tray for easy dispensing. After dispensing, the pills are easily poured back into their respective bottles through the pill tray s spout.

In the preferred embodiment the kit includes a pill cutter. This pill cutter is of a clear plastic material, so it is therefore easy to see through. This pill cutter preferably has a child-proof safety lock as it has a sharp, stainless steel blade. However, the pill cutter is easy for an adult to open.

In the preferred embodiment the kit includes a pencil. Preferably this pencil has a foam grip pad near the tip for comfort.

In the preferred embodiment the kit includes an eraser. This eraser preferably should be large, easy to grip, and of the non-smear type, as there is erasing done on the medication chart, using this system.

BRIEF DESCRIPTION OF THE DRAWINGS

FIG. 1 is a reduced view of a Medication Chart.

DETAILED DESCRIPTION

Figure 2:
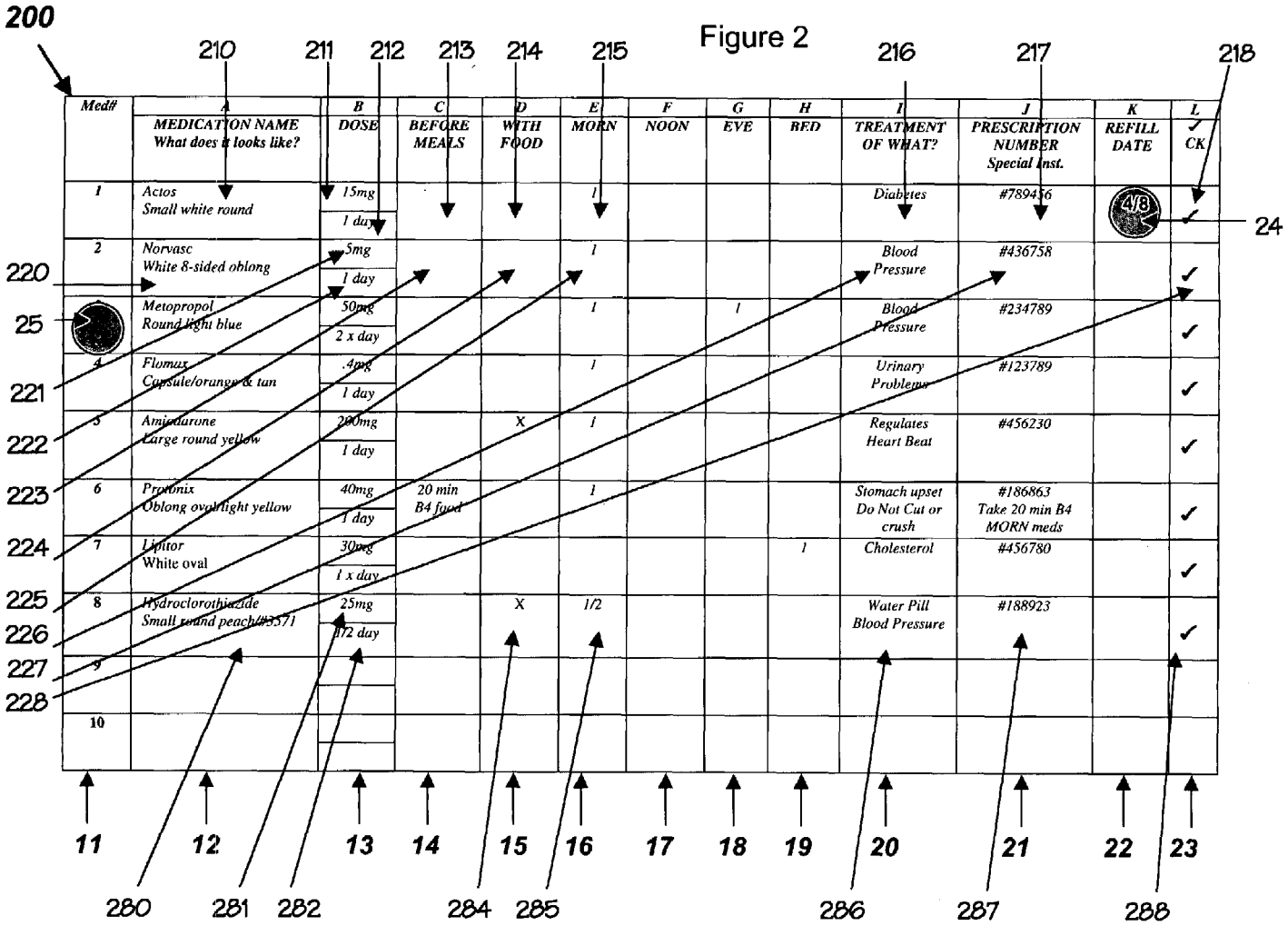
FIG. 2 is a reduced view of a Medication Chart, which has been filled in as an example.

FIG. 1 is a blank Medication Chart used in the method of aiding in the management of multiple medications, wherein the left column 11 is pre-numbered for listing each medication. in the preferred embodiment of the system, three blank medication charts, with numbering in the far left column 11 from 1 through 30 are enclosed; however it will be apparent to one skilled in the art that the method can be performed using any number of charts. In one embodiment, blank page number 1 in left hand column 11 has pre-printed numbers 1 through 10. Blank page number 2 in left hand column 11 has pre-printed numbers 11 through 20. Blank page number 3 in left hand column 11 has pre-printed numbers 21 through 30. The name of medication, the medication s generic name, if applicable, and a brief description of what the medication visually looks like is written in column A 12. Column B 13 is used to list the dosage currently being taken and how many doses per day are taken. Column C 14 is checked if this medication is recommended to be taken before meals. Column D 15 is checked if this medication is recommended to be taken with food. Column E 16 indicates whether the dosage needs to be taken per day in the morning. Column F 17 indicates whether the dosage needs to be taken at noon. Column G 18 indicates whether the dosage needs to be taken in the evening. Column H 19 indicates whether the dosage needs to be taken per day at bedtime. Column I 20 is used to write a brief description of why this medication taken. Column J 21 indicates where the prescription number and special instructions for this medication is written. Column K 22 indicates where the date a refill for this medication is needed is written. Column L 23 indicates where an erasable checkmark is made when the medication has been dispensed for the week into all the compartments of the weekly pill organizer 700.

Figure 3:
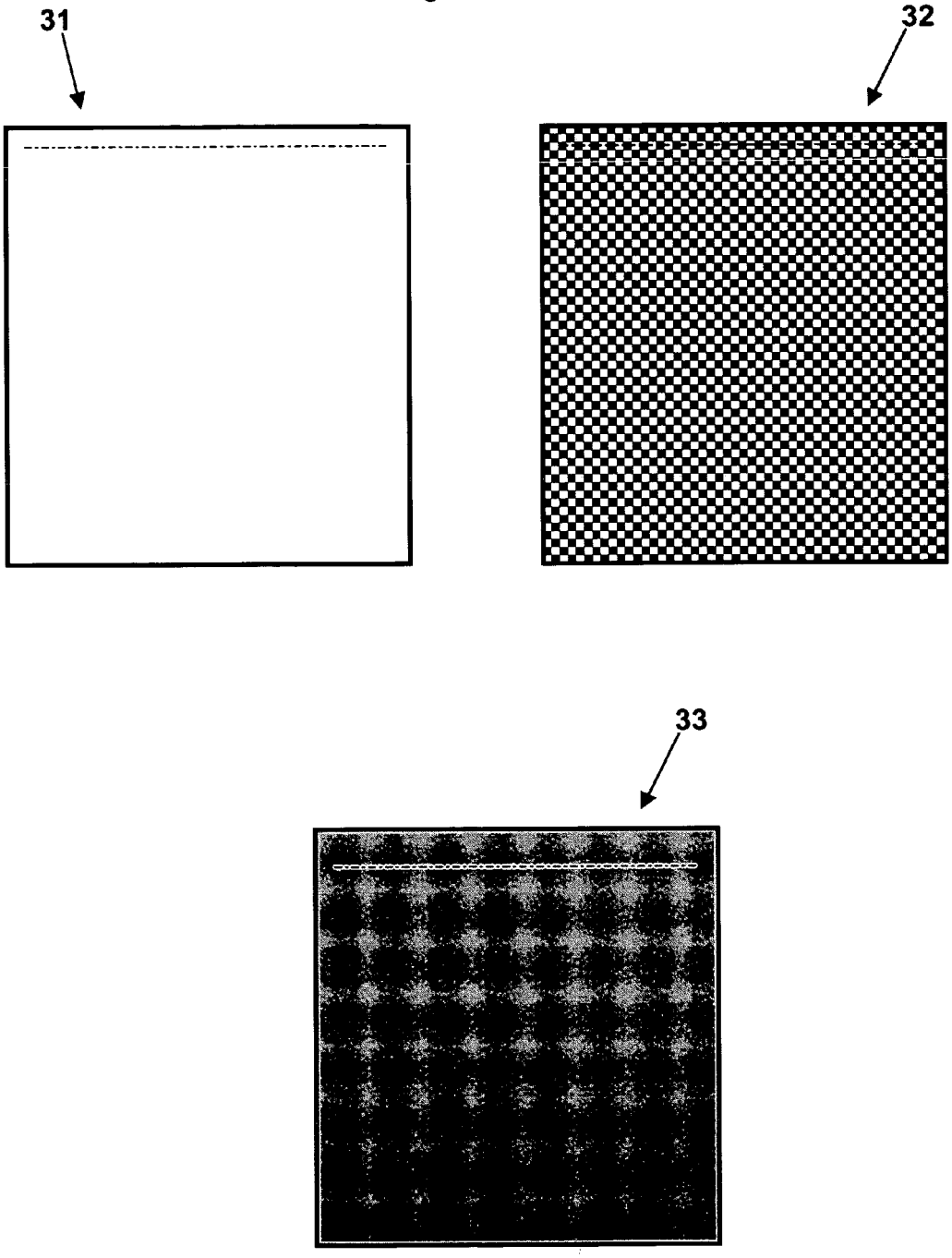
FIG. 3 is a reduced view of zippered plastic bags.

FIG. 3 shows three colored zippered bags. In the preferred embodiment, one colored zippered bag 31 is used for current medications, another colored zippered bag 32 is used for discontinued medications (coinciding with the same color discontinued medication removable sticker 50), and a third colored zippered bag 33 is used for refills (coinciding with the same color refill removable sticker 60.) It will be apparent to one skilled in the art that a variety of containers and container indicators can be used to contain and to mark the current, refill, and discontinued medications.

Figure 4:
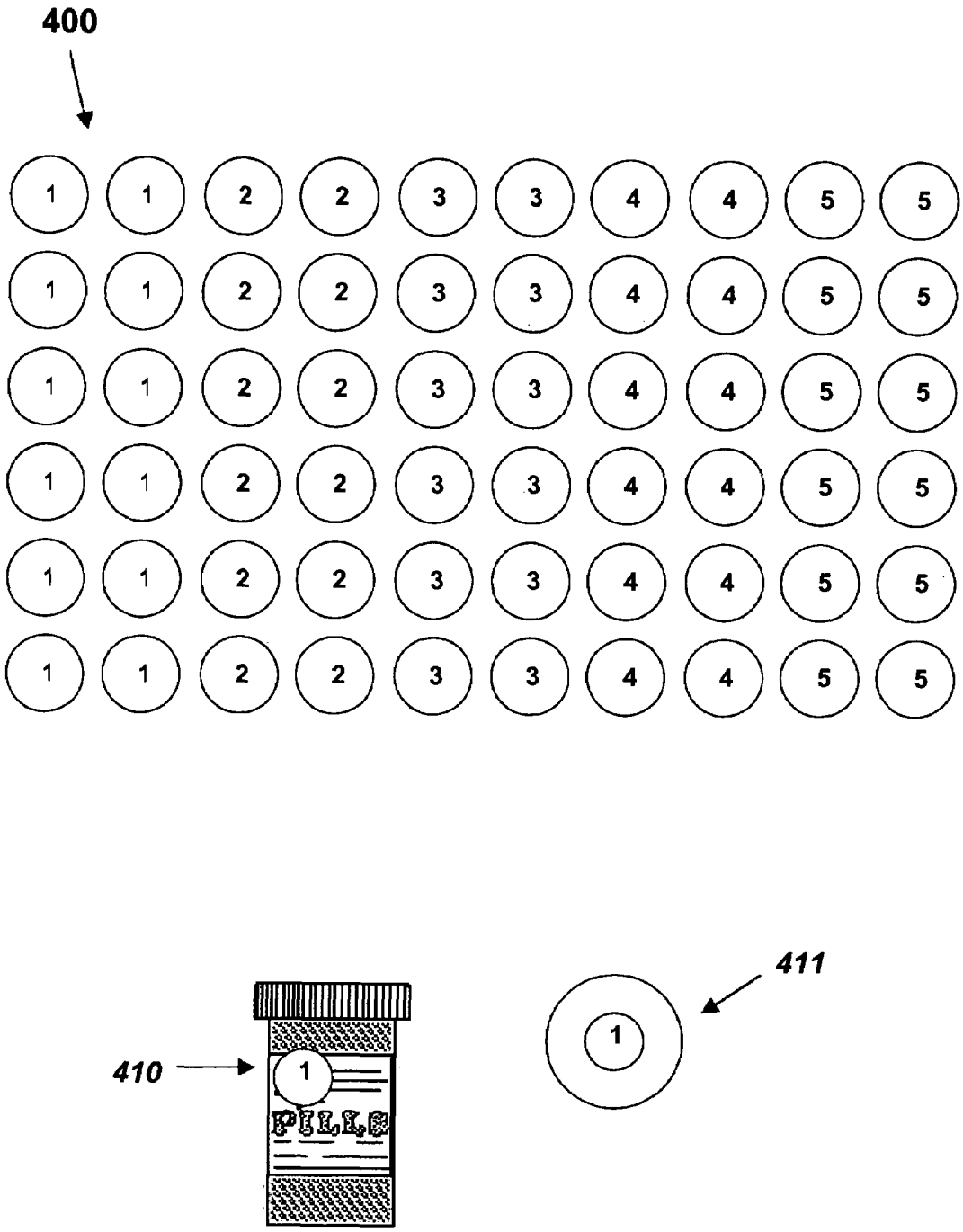
FIG. 4 is a reduced partial view of pre-numbered stickers.

FIG. 4 shows a reduced view of a sample page of pre-numbered stickers 400, for labeling prescription bottle 410 and cap 411. In the preferred embodiment, these pre-numbered stickers have numbers from 1-30, two columns of numbers providing two of each of five numbers in each row to a page across from left to right. In the preferred embodiment 24 of each number are included on a page. In the preferred embodiment page 1 has pre-numbered stickers 1-5, page 2 has pre-numbered stickers 6-10, page 3 has pre-numbered stickers 11-15, page 4 has pre-numbered stickers 16-20, page 5 has pre-numbered stickers 21-25, and page 6 has pre-numbered stickers 26-30. In the preferred embodiment there is a total of six pages of pre-numbered stickers, numbered 1 through 30.

Figure 5:
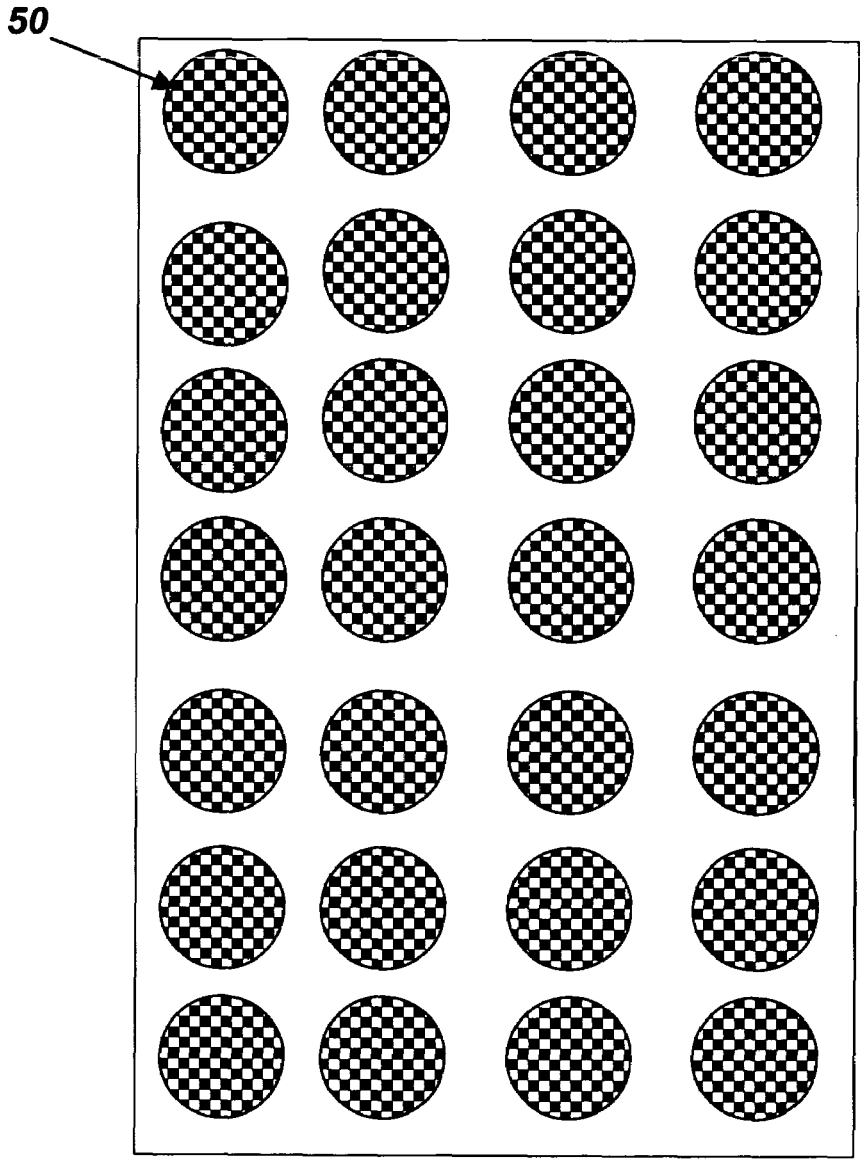
FIG. 5 is an enlarged view of removable stickers used for identifying discontinued medications.

FIG. 5 shows an enlarged view of colored removable stickers 50, which are placed on medication chart in left hand column 11 when a medication is discontinued. This medication bottle is then placed in the colored zippered bag 32 having the same color as the discontinued stickers. In one embodiment, the discontinued medication bag and stickers are both red. It will be apparent to one skilled in the art that a variety of sticker indicators can be used to mark the stickers for current, refill, and discontinued medications. However, the preferred embodiment uses colored stickers, as colors are easy for most people to identify.

Figure 6:
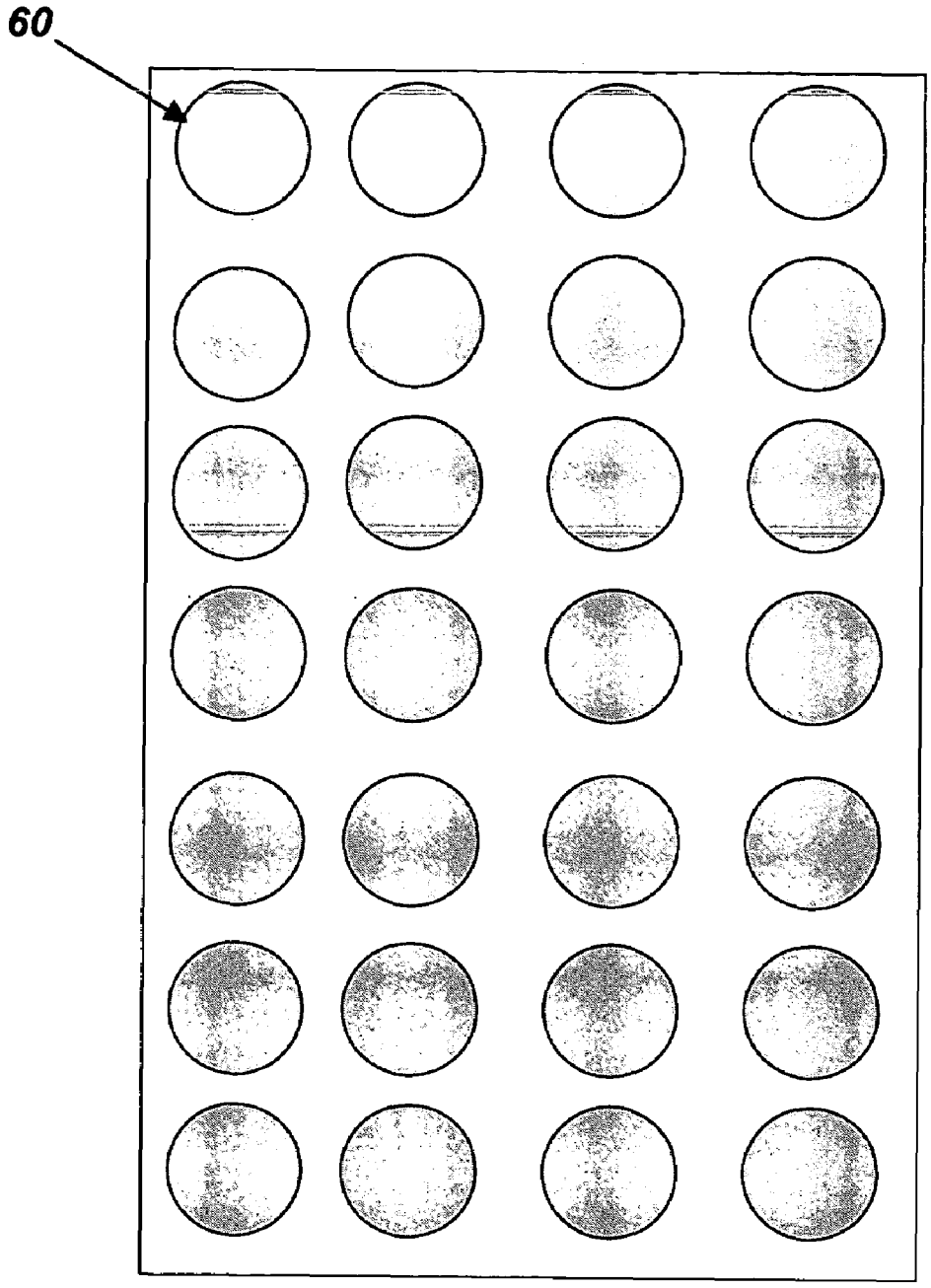
FIG. 6 is an enlarged view of removable stickers used in identifying medications needing refilled.

FIG. 6 shows an enlarged view of colored removable stickers 60 for placing on medication chart in column K 22 with a date written on the sticker when a medication needs to be refilled. This medication bottle is then placed in the same colored zippered bag 33 having the same color as the refill stickers. In one embodiment, the refill medication bag and stickers are both yellow.

Figure 7:
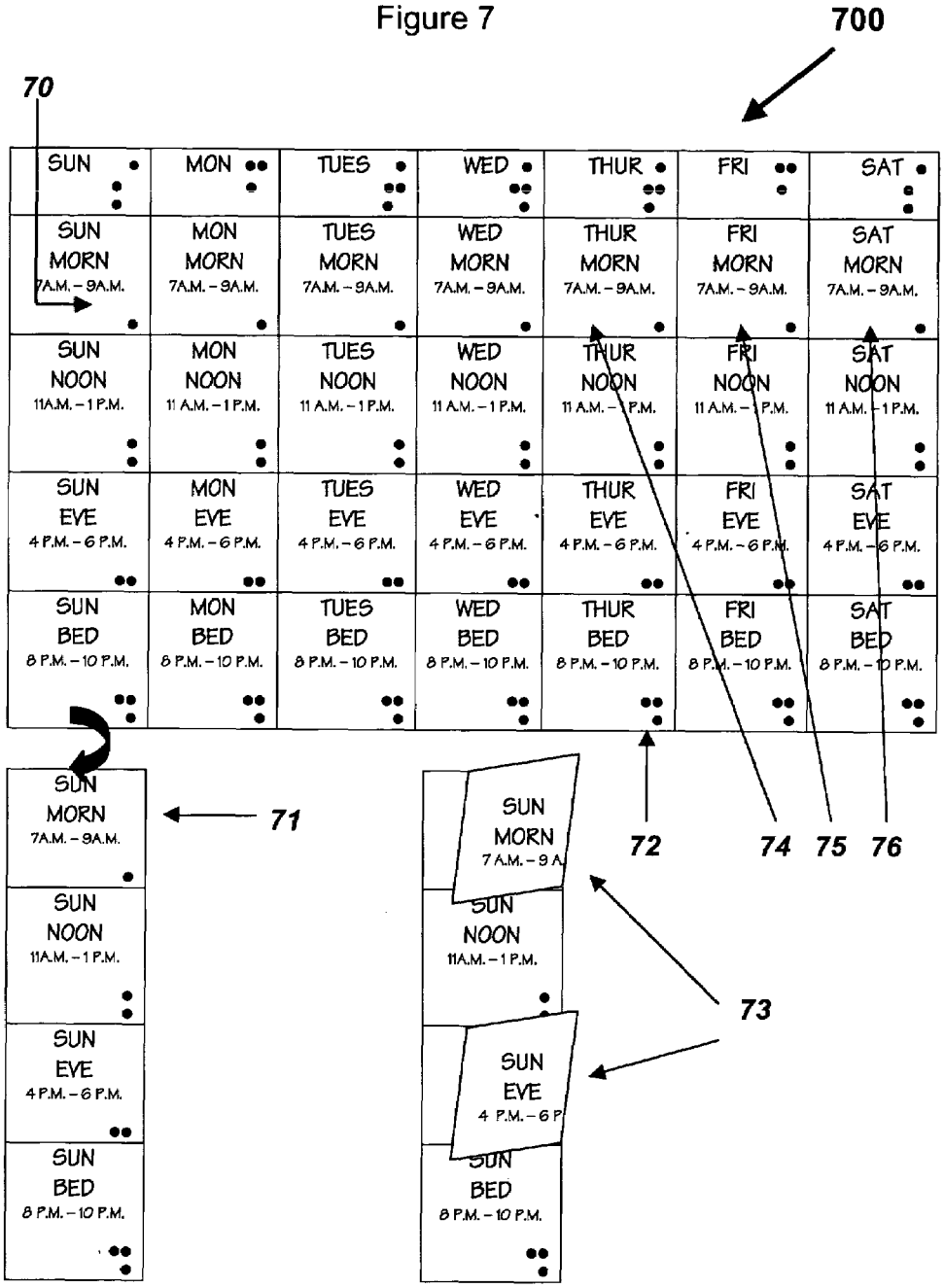
FIG. 7 is a reduced view of a weekly pill organizer.

FIG. 7 shows a reduced view of a weekly pill organizer for storing dispensed medications to be taken daily at specific times. In the preferred embodiment, each individual day s medication compartments are removable 71. In the preferred embodiment, each day/time for each compartment, as indicated by black dots, are in Braille 72. In the preferred embodiment, all day/time individual compartments within the weekly pill organizer have flip lids 73, which open and remained fixed.

Figure 8:
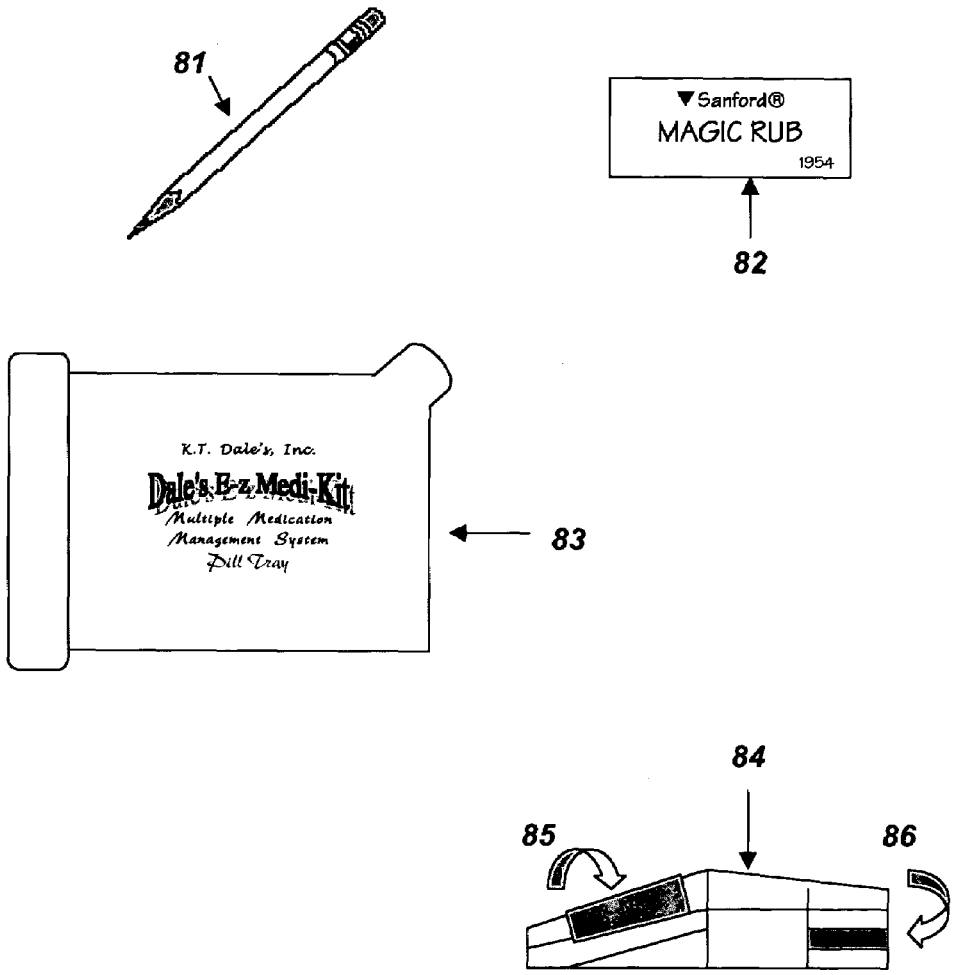
FIG. 8 is a reduced view of a pencil, eraser, pill counting tray and a pill cutter.

FIG. 8 shows reduced views of additional items which are useful in the preferred embodiment of the system, but are not essential, including a pencil 81, an eraser 82, a pill tray 83, and a pill cutter 84 with a childproof safety lock 86, with a sharp, stainless steel blade 85.

Figure 9:
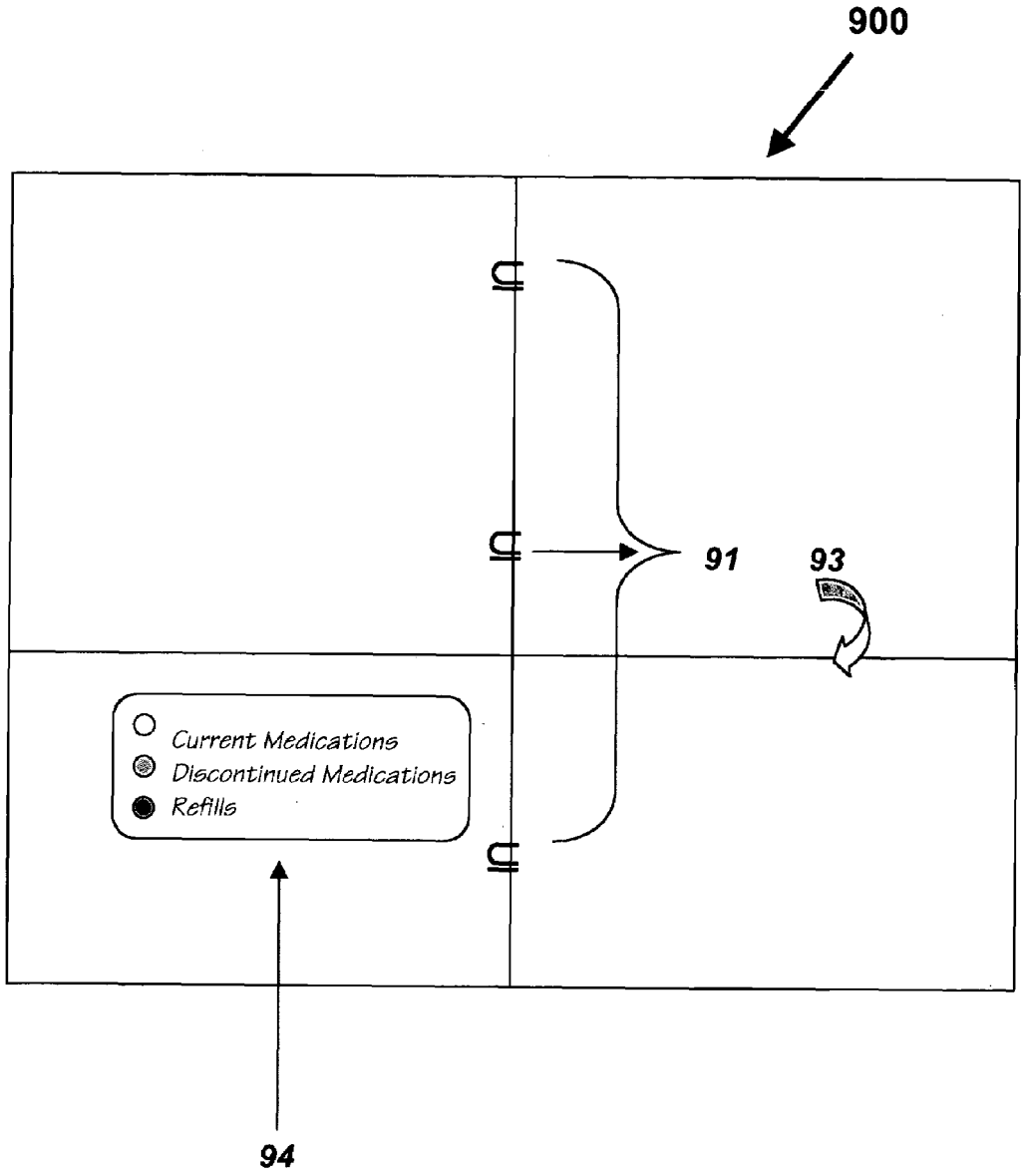
FIG. 9 is a reduced view of a portfolio.

FIG. 9 shows a reduced view of a three-ring portfolio 91, which is used in the preferred embodiment for storing the pre-numbered stickers 400, the colored removable stickers 50, and the colored refill stickers 60. A pocket on the right 93 is used for storing medical papers (discharge instructions from a hospital, doctor s notes, instructions on medications given from the pharmacy, or other important medical information.) A label 94, with the color-coded information of the method is affixed.

Figure 10:
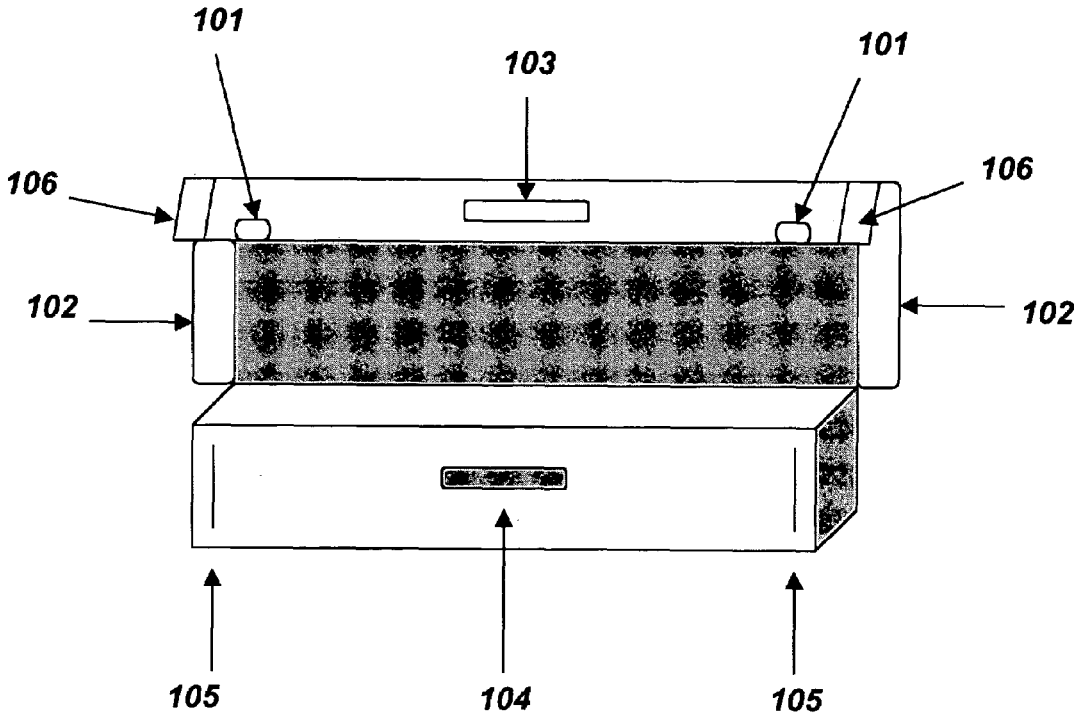
FIG. 10 is a reduced view of a storage container for the kit.

FIG. 10 shows a reduced view of a corrugated box 12 depth×16½ length×4 high which is used in the preferred embodiment for storing the components of the medication management kit. Cut out tabs 101 for ease in opening. Flaps 102, folding inside to box to enclose contents. Slot 103 for handle 104 to reach through. Plastic handle 104 attached for carrying. Opening 105 for tabs 106 to lock lid into place.

EXAMPLE

The following example illustrates how the present invention is used to aid management of multiple medications.

FIG. 2 shows a filled in sample Medication Chart 200 used in the method of aiding in the management of multiple medications, wherein the left column 11 is pre-numbered for listing of each medication. The following description demonstrates how the chart is completed and the medications are organized. In the preferred embodiment, step-by-step instructions are color-coded, coinciding with columns A through J 11, 12, 13, 14, 15, 16, 17, 18, 19, 20, 21, 22, 23 on the Medication Chart 200 for ease of reference. In the preferred embodiment, a pencil is used to enter the information so that the information can be changed. However, it will be apparent to one skilled in the art that any method, which allows the information on the chart to be changed, can be used.

The columns of sample Medication Chart 200 are filled in as demonstrated below.

In the preferred embodiment, the first column 11 in chart 200 is pre-numbered to assign each medication a number. Stickers are placed in this column as well.

Beginning with the first medication (#1) Actos from the sample Medication Chart 200, The colored pre-numbered stickers 400 are taken from the portfolio 900 beginning with pre-numbered sticker #1, used to label the medication and medication cap. In the preferred embodiment, the sticker color for current (not discontinued) medications not needing refills is white.

A sticker #1 is taken from the sheet of pre-numbered stickers 400, and this sticker is placed on the bottle 410 and sticker #1 is placed on the cap 411. Preferably the writing on the medication bottle is not covered by the sticker. Next, information about the medication is entered onto the chart 200 The second column, column A 12, is used for the medication name and description. First, the name of the medication, Actos, is written in the first box 210 in column A 12. If a generic medication has been given by the pharmacy, that generic name should be written in box 210 as well.

Next, a description of what the pills look like is written in box 210. Actos is a small, white round pill. This description of the medication is written in below the name of the medication in box 210. If the dosage changes on any medication, the pills will look different and the description of the pill is changed. A description is often listed on the medication bottle by the pharmacy. The pill description can include the size, shape, color, and possibly a number printed on the pill.

The dosage of the medication and the amount taken per day is written in column B 13. In this example, the doctor has prescribed 1.5 mg of Actos, 1 time each day to be taken in the morning. This information is entered in column B in box 211 and box 212. An X is placed in column C 14 box 213 if this medication is suggested to work best on an empty stomach. There are no recommendations for Actos so box 213 in column C 14 is left blank.

An "X" is placed in column D 15 box 214 if this medication is suggested to be taken with food. There are no recommendations for Actos so box 214 in column D 15 is left blank.

Columns E 16, F 17, G 18 & H 19 are reminders for when this medication should be taken. The number of pills to be taken is written in these columns (MORN) 16, (NOON) 17, (EVE) 18, (BED) 19. Actos is taken as one pill in the morning so the number 1, is written in box 215 of column E 16. Column I 20 is used to write the purpose of the medication. Actos is for the treatment of Diabetes, so "Diabetes" is written in box 216 of column I 20. This description of the medication helps a person to understand why these medications are being taken.

Column J 21 is used to write the prescription number for this medication given by the pharmacy from the medication bottle. In this example, the prescription number on the Actos medication bottle is #789456, so that number is written in box 217 of column J 21.

Next, the medications are dispensed. In the preferred embodiment, a pill tray 83 is used to hold several of the Actos pils.

All compartments of the weekly pill organizer 73 are opened for easy dispensing. Actos pills for the entire week are dispensed into the Weekly Pill Organizer 700 according to the times and amounts marked down in column E 16, F 17, G 18 & H 19. As Actos is taken in the morning as shown in box 21 one pill is placed in each of SUN, MON, TUES, WED, THUR, FRI, and SAT in the MORN compartments 70 of the weekly pill organizer 700.

Next, refills are managed. The Actos medication bottle is checked to see if there are enough pills for next week s dispensing. At least 7 pills will be required.

If there are not enough pills for next week s dispensing left in the Actos prescription bottle, more will be needed for next week s dispensing. In this case, a colored refill sticker 60 is placed in box 24 of column K 22. In the preferred embodiment, the refill stickers are yellow. The date the refill will be needed is written on the refill sticker. For example, the date, April 8 is written in column K 22 on the refill sticker as this is the date dispensing will be done again for the next week.

Put the Actos medication bottle in the zippered bag 33, marked refills until the prescription for Actos is picked up at the pharmacy.

The reason a yellow removable sticker 60 is placed on the sample medication chart 200 in column K 22 for all medications which need to be refilled, is that when dispensing medications for the week has been completed, a person can look in column K 22 and see which medications have a yellow sticker 60. The prescription numbers are listed for each medication in column J 21. A person can call the pharmacy, read the pharmacist the prescription numbers from column J 21, having a removable yellow sticker 60 in column K 22 and order all prescriptions filled at one time, picking them up from the pharmacy in one trip. This procedure saves the person or caregiver, and the pharmacists, time and energy.

After Actos pills have been placed in all MORN compartments 70 of the weekly pill organizer 700, a checkmark is placed in box 218 of column L 23. A checkmark is made only after dispensing this medication for the entire week. All checkmarks in column L 23 are erased before beginning dispensing medications the following week.

At this point, charting and dispensing for medication #1, Actos, is complete.

The procedure is repeated for the next medication. In this example, the second medication is Norvasc.

First a pre-numbered sticker #2 is placed on the Norvasc bottle 410 and a sticker #2 on the cap 411. The name of the medication and a description of the pill is written in column A 12. If a generic medication was given by the pharmacy, that generic name would be written here as well. There is no generic name for Norvasc. Norvasc is a white, 8-sided oblong pill. This description of the medication is written in below the name of the medication in box 220.

The dosage of the medication and the pills per day is written in box 221 and box 222 of column B 13 respectively. The doctor has prescribed 5 mg of Norvasc, 1 time each day. An X is placed in box 223 column C 14 if this medication is suggested to work best on an empty stomach. There are no recommendations for Norvasc. Box 223 in column C 14 is left blank.

An "X" is placed in box 224 column D 15 if this medication is suggested to be taken with food. There are no recommendations for Norvasc. Box 224 in column D 15 is left blank.

Columns E 16, F 17, G 18, and H 19, are for reminders when this medication should be taken. Norvasc is taken as one pill in the morning, so the number 1 is written in box 225 of column E 16.

Column I 20 is used to write briefly the purpose of the medication. Norvasc is for the treatment of Blood Pressure, so "Blood Pressure" is written in box 226 column I 20. This description of the medication helps a person to understand why these medications are taken.

Column J 21 is used to write the prescription number from the medication bottle in. The prescription number on the Norvasc medication bottle is #436758, which is written in box 227. Finally, a checkmark is made in column L 23, box 228.

Next, the Norvasc pills are dispensed in a similar manner as described for the Actos pills. In this example there are enough Norvasc pills for the following week. Therefore, a refill is not needed. This medication bottle is placed in the Current Medications container 31, the color of which matches the color of the current medication stickers. In the preferred embodiment, the current medications container is a zippered white plastic bag.

Additional medications for the current week are managed in a similar fashion.

An advantage of the present invention is that it allows for efficient organization of changing medications. This advantage will be demonstrated by continuing the example on a subsequent week.

After refills have been picked up at the pharmacy, the yellow sticker 60 is removed from column K 22 on the medication chart 200 and the medication bottles are removed from the refill bag 33. The medications from the refill bag are matched to the refilled medications picked up at the pharmacy. From the pre-numbered sticker pages 400, the same number sticker, which is on the old prescription bottle, is selected and placed on the newly refilled prescription bottle and the newly refilled prescription bottle s cap. The medication chart 200 is checked to ensure that the number on the chart matches the number on the new refilled prescription bottle and the new refilled prescription bottle s cap. Any pills left in the old prescription bottle, which was taken from the refill container bag 33, are poured into the new prescription bottle, keeping medications organized. These refilled medication bottles are now placed in the current medications zippered bag 31. In this example, the Actos medication required a refill. Once the Actos refill is picked up from the pharmacy, the colored sticker in box 24 of sample chart 200 is removed. The Actos bottle is removed from refill bag 33 and the remaining Actos pills are placed into the new bottle of Actos pills. A current medication sticker #1 is placed on the Actos bottle and lid, and the chart 200 is checked to ensure that Actos is Med #1. Finally, the new Actos bottle is placed into the current medications bag.

Now, all of the current medications, including those newly refilled, are ready to be dispensed. Before medications for a new week are dispensed, the checkmarks in column L 23 are erased. Next the current medications are removed from the current medications bag 31, and are lined up by number at the top of the medication chart 200. This step is facilitated by the numbers from column A 11 on the chart 200 and pre-numbered stickers 400 on the medication bottles 410 and medication s cap 411.

Another advantage of the present invention is how discontinued medications are managed. This advantage will be apparent to one skilled in the art by the following example.

In this example, the doctor has discontinued Med #3 on the sample Medication Chart 200, Metopropol. This medication, Metopropol, has already been dispensed for the entire week into the weekly pill organizer 700 in the MORN compartments 70, and it is now the middle of the week (Wednesday) when this medication, Metopropol, is discontinued by the doctor and replaced with a new medication, which may work better. The description of the Metopropol pills is noted from either the chart 200 or any remaining Metopropol pills and the pills are removed from the weekly pill organizer 700 for the remaining days of the week THUR, FRI, SAT, and put back into the prescription bottle #3 medication, Metopropol.

The Metopropol medication bottle is placed in the discontinued medications container, which in the preferred embodiment is a red zippered bag 32. The Metopropol is kept, in the event the doctor prescribes Metopropol again at a later date. This situation often happens after the doctor tries a new medication for the same problem only to discover the first medication was working better. By keeping these discontinued medications contained and in one place, costly medications are not misplaced or thrown away.

A colored, removable discontinued medication sticker 50 is placed over the Metopropol number (#3) in box 25 of the first column 11 on the sample Medication Chart 200. In the preferred embodiment, both the discontinued medication sticker and the discontinued medication container are red. The date the medication was discontinued is written on the sticker 50. If the doctor prescribes this #3 medication, Metopropol again later, the red sticker 50 is removed from the medication chart 200. The #3 medication bottle, Metopropol, is removed from the discontinued medication container 32, dispensed into the weekly pill organizer 700, and placed into the current medication container 31. The discontinued number is not used for any new prescribed medications. New prescribed medications get a new, unused number from the medication chart 200.

Another advantage of the present invention is that new medications can be added efficiently. In this example, the doctor has prescribed a new medication Hydroclorothiazide to replace the #3 medication, Metopropol, which is for the same problem but may work better. A new, unused number from the sample Medication Chart leftmost column 11 is used. This new, unused number will be Med#8. The medication information is filled in for the new medication Med#8 medication, Hydroclorothiazide from left to right, beginning with the name, Hydroclorothiazide. The description, small round peach, is written below the name of Med#8 medication, Hydroclorothiazide, and also the number on the pill, 3571 is written in box 280. (This number has been imprinted on the pill by the pharmaceutical company to help in identification.) The lowest strength of Hydroclorothiazide available is 25 mg, which is written in box 281. The doctor has prescribed ½ of the 25 mg dosage per day, which is written in box 282, to be taken in the morning, beginning on Thursday. The Med#8 medication, Hydroclorothiazide needs to be cut in half before dispensing into the weekly pill organizer 700. The pill tray 83 and pill cutter 84 are used to cut several of the Med#8 medication, Hydroclorothiazide pills in half as the doctor has prescribed Med#8 medication, Hydroclorothiazide, a ½ dose of the 25 mg to be taken in the morning per day. An "X" is placed in box 284 of column D 15, as this Med#8, medication is recommended to be taken with food. ½ of a 25 mg Hydroclorothiazide is taken in the morning, so the number ½ is written in box 285 of column E16. Med#8 medication, Hydroclorothiazide is a water pill and also treats blood pressure. In box 286 of column I 20 what Med#8 medication, Hydroclorothiazide is treating is written. The prescription number for Med#8 medication, Hydroclorothiazide is #188923 and is written in box 287 of column J 21 #188923. This Med#8 medication, Hydroclorothiazide is then dispensed into the weekly pill organizer 700. ½ pill is put in the THUR MORN compartment 74, ½ pill in the FRI MORN compartment 75 and ½ pill in the SAT MORN compartment 76. A checkmark is then made in box 288 of column L 23 after this #8 medication. Hydroclorothiazide has been dispensed into the weekly pill organizer 700. The #8 medication bottle, Hydroclorothiazide is placed into the Current Medications container 31.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof or limited thereto.

I claim:

1. A kit for managing multiple medications, said kit comprising:

a first container of a first color for storing a plurality of current medications;

a second container of a second color for storing a plurality of refill medications;

a third container of a third color for storing a plurality of discontinued medications;

a first plurality of numbered labels of said first color for labeling the plurality of current medications;

a second plurality of labels of said second color for labeling the plurality of refill medications;

a third plurality of labels of said third color for labeling the plurality of discontinued medications;

a pill organizer; and a medication chart including a numbered first label column, in which a label of said third plurality of labels can be optionally affixed, the numbers of said first label column matching the numbers of said first plurality of numbered labels, said medication chart also including further columns for making notes, including a first column for noting medication name and description, a second column for noting dose, a third column for noting third before meals, a fourth column for noting third with food, a plurality of columns for noting medication time, a fifth column for noting treatment, a sixth column for noting prescription number, a seventh column for noting refill date, and an eighth column for making a check mark.

2. The kit of claim 1 wherein said kit further comprises a pencil;

a carrying container;

a portfolio; and a pill cutter.

3. A method for managing multiple medications comprising entering medication information for a first medication in a row on a medication chart, said row having a first number;

placing a first current label of a first plurality of labels onto a first bottle for said first medication, said first current label having a first color and having preprinted said first number;

dispensing said first medication into a pill organizer;

placing said first bottle into a first container of said first color;

counting a number of pills in said first bottle;

placing a refill label of a second color on said chart;

placing said first bottle in a second container of a said second color;

obtaining a refill bottle of said first medication;

removing said first bottle from said second container;

placing a pill from said first bottle into said refill bottle;

placing a second current label of said first plurality onto said refill bottle;

removing said refill label from said chart; and placing said refill bottle in said first container.

4. A method for managing multiple medications comprising entering medication information for a first medication in a row on a medication chart, said row having a number;

placing a first current label of a first plurality of preprinted numbered labels onto a first bottle for said first medication, said first current label having a first color;

dispensing said first medication into a pill organizer;

placing said first bottle into a first container of said first color;

placing a discontinued label of a second color onto said chart;

placing said first bottle into a second container of said second color;

removing said first bottle from said second container;

redispensing said first medication into said pill organizer;

replacing said first bottle into said first container; and removing said discontinued label from said chart.

* * * * *